United States Patent [19]

Saethre

[11] 3,964,471

[45] June 22, 1976

[54] CHILD'S BATHING CABINET

[75] Inventor: Magnus Saethre, Brooklyn, N.Y.

[73] Assignee: Lawrence Peska Associates, Inc., New York, N.Y. ; a part interest

[22] Filed: June 16, 1975

[21] Appl. No.: 587,368

[52] U.S. Cl. ..... 128/65; 4/175; 4/185 B; 4/185 AB

[51] Int. Cl.[2] ..... A61H 9/00

[58] Field of Search ..... 128/65, 66, 365, 369; 4/175, 185 B, 185 AB, 178

[56] References Cited

UNITED STATES PATENTS

| | | | |
|---|---|---|---|
| 2,292,666 | 8/1942 | Schurtz | 128/66 X |
| 2,312,524 | 3/1943 | Cox | 128/66 X |
| 2,733,711 | 2/1956 | Gibson | 128/66 X |
| 3,595,224 | 7/1971 | Walter | 4/185 AB |
| 3,619,823 | 11/1971 | Sackett | 4/185 B |

*Primary Examiner*—Lawrence W. Trapp

[57] ABSTRACT

A bathing cabinet for children has a base member which includes a peripherally extending wall section and a floor element joined to the lower extremity thereof. A dome member of which at least a portion is transparent is mounted atop the base member. Conduits are connected to the base member to supply water thereto and drain water therefrom. An agitator is mounted within the base member and a seat is supported within the cabinet by the wall section.

2 Claims, 3 Drawing Figures

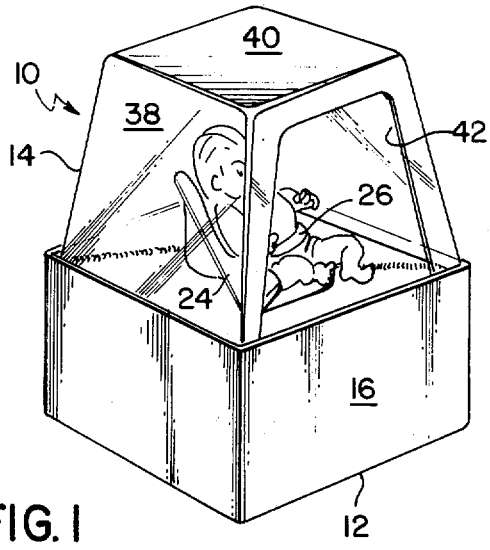
FIG. 1
FIG. 2
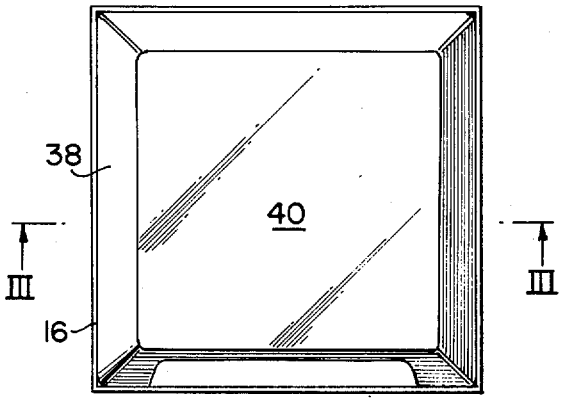
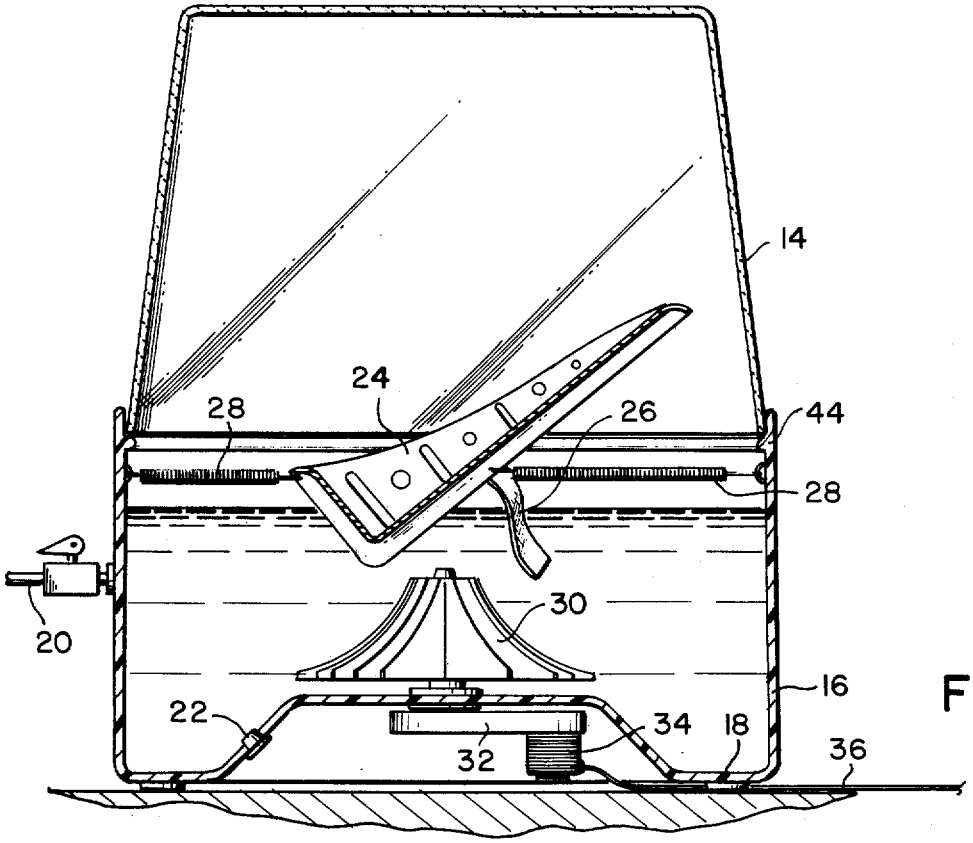
FIG. 3

CHILD'S BATHING CABINET

BACKGROUND OF THE INVENTION

The present invention relates to bathing cabinets for children.

It has been known heretofore to provide bathing cabinets of various constructions to facilitate the bathing of aged and physically handicapped persons. A typical prior art device of this character is disclosed in U.S. Pat. No. 3,630,193 issued Dec. 28, 1971 to Lancaster. This earlier construction consisted of a rectangular open-top cabinet having a hinged door on one side thereof mounting a spring-loaded seat. Conduit means are provided for introducing water into the cabinet and a drain is provided for enabling the discharge of water from the cabinet.

None of the bathing cabinets available heretofore have been designed particularly for children so as to provide for conditioning of the child to a moving body of water while being safely positioned within the body of water and visible to the attending parent. The fear of water is prevalent in children and to date there is no device which offers the dual advantages of a safe environment in which the child can be placed to function independently within an active moving body of water and one which can nevertheless be within momentary visible range of the parent in the event of an emergency.

SUMMARY OF THE INVENTION

It is an object of the invention to provide a bathing cabinet for children within which the child can be safely positioned in a body of active water while being entirely visible to an attending parent.

It is another object of the invention to provide a bathing cabinet for children adapted to provide a safe seat for a child and an agitated body of water within which the child is immersed to a preselected depth.

Other objects and advantages of the invention will become readily apparent to persons skilled in the relevant art from the following description of the invention.

According to the present invention there is provided a bathing cabinet for children comprising a base member which includes a continuously extending closed wall section having a floor element joined to the lower extremity thereof, a dome member consisting essentially of a side wall portion and a top enclosure supported by the upper portion of said wall section, at least a substantial segment of said side wall portion of said dome being constructed so as to provide visual access to the interior of the cabinet, seating means being positioned within the cabinet within full view of the transparent segment of said dome, water inlet and outlet means connected to said base member for supplying water thereto and for draining water therefrom, water agitator means mounted within said base member, and means for imparting movement to said agitator means.

BRIEF DESCRIPTION OF THE DRAWINGS

In order that the invention may be more fully understood it will now be described, by way of example, with reference to the accompanying drawing in which:

FIG. 1 is a perspective view of the bathing cabinet of the invention;

FIG. 2 is a top plan view of the bathing cabinet shown in FIG. 1; and

FIG. 3 is a side elevation, partly in section, of the bathing cabinet of the invention taken along line III—III of FIG. 2.

DETAILED DESCRIPTION OF THE INVENTION

Referring to the drawing there is shown a bathing cabinet for children 10 consisting essentially of a base member 12 and a dome member 14. The base member includes a continuously extending wall section 16 which is joined at the lower extremity thereof to a floor element 18. Thus formed the wall section and floor constitute a tub within which water may be introduced to a predetermined depth.

Connected to the base member, preferably through the wall section thereof, is an inlet conduit 20 for water. A drain outlet 22 is incorporated in the floor element so that the water within the tub can be emptied when desired. A stopper (not shown) or a petcock (not shown) may be provided operable in conjunction with the drain outlet for selectively retaining the water within the tub or permitting the water to drain therefrom.

Mounted within the tub section of the cabinet is a seat 24 having belt means 26 for securing a child safely therein. As shown the seat is suspended from the wall section by means of a plurality of springs 28. The use of a resilient mounting for the seat is preferred since it affords an opportunity for the child to bounce about within the water in a manner simulating play therapy. This serves to heighten the child's enjoyment of the water and accelerates his acceptance of the water environment. Although not shown the inlet and drain outlet may be provided with water level controller means for maintaining a preselected depth of water within the tub. Such means are known and presently available from numerous manufacturers. Therefore, it is not deemed necessary to encumber the present specification with the constructional details of such devices.

Mounted within the tub section of the cabinet there is provided an impeller-agitator 30. The agitator may be supported directly upon the floor element 18 or it may be mounted upon brackets which rest upon the floor element or are supported by the wall section of the cabinet. Suitable transmission means 32 of conventional construction may be provided beneath the floor element of the cabinet. An electric motor 34, connected to a source of electric power by cable 36 may be employed to drive the transmission means and thus effect rotation of the impeller-agitator. The agitator 30 may be driven in an oscillating fashion whereby it is caused to rotate through a fractional portion of a single revolution. By functioning in this manner the body of water contained within the tub is given a pulsating active movement and serves to physically stimulate the awareness of the child to the water environment. It also serves to cyclically and continuously subject at least the legs and body of the child to a surging mass of the water which, when the child is being bathed, rinses any soapy film from the surfaces of the child.

Supported at the upper portion of the wall section is dome member 14. The dome is formed with a side wall 38 and a top enclosure 40. The side wall is constructed so as to provide visual access to the interior of the cabinet. Thus, preferentially all of the side wall may be fabricated of a transparent material such as glass or a suitable plastics material. If desired a portion of the side wall 42 may be open. The top enclosure may be made either of a transparent or opaque material. As shown the dome member is separable from the base member. It may, for example, be pivotally mounted on the wall section 16 as by hinge means 44. The hinge may be conveniently formed by a protruding bead on the interior of the wall section 16 dimensioned to be received within a peripherally extending recess at the bottom of the dome member. By providing for such pivotal movement of the dome it is possible to swing the dome upwardly about hinge 44 to provide access to the interior of the cabinet for placement of the child in the seat therein. However, it will be understood that opening 42 in the dome member may be employed for the purpose of placing the child within the cabinet or of removing him therefrom. It will also be appreciated that the dome member may rest upon the upper portion of the wall section and be separable therefrom by lifting same out of supporting relationship therewith. It will also be appreciated that top enclosure 40 may be dispensed with so that access to the interior of the cabinet may be had through the top of the dome member.

It will be seen from the foregoing that a bathing cabinet for a child has been provided which enables the positioning of the child therewithin upon a seat whereby the child may be bathed or left to play while immersed to a desired depth within a pulsating body of water. The parent, while the child is so positioned within the cabinet may attend to the bathing of the child or may leave the child unattended yet within immediate range in case of an emergency and within full view at all times and from all angles.

What is claimed is:

1. A bathing cabinet for children comprising a base member which includes a continuously extending closed wall section having a floor element joined to the lower extremity thereof, a dome member consisting essentially of a side wall portion and a top enclosure supported by the upper portion of said wall section, at least a substantial segment of said side wall portion of said dome being constructed so as to provide visual access to the interior of the cabinet, seating means being positioned within the cabinet within full view of the transparent segment of said dome, water inlet and outlet means connected to said base member for supplying water thereto and for draining water therefrom, water agitator means mounted within said base member, and means for imparting movement to said agitator means.

2. A bathing cabinet according to claim 1, wherein said dome member is pivotally mounted on said base member.

* * * * *